US006076320A

United States Patent [19]

Butler

[11] Patent Number: 6,076,320

[45] Date of Patent: Jun. 20, 2000

[54] FOUNDATION FOR A MODULAR STRUCTURE

[76] Inventor: Michael Butler, 31078 Turner Rd., Fort Bragg, Calif. 95437

[21] Appl. No.: 08/871,395

[22] Filed: Jun. 9, 1997

Related U.S. Application Data

[63] Continuation-in-part of application No. 08/818,497, Mar. 14, 1997, abandoned, which is a continuation-in-part of application No. 08/600,408, Feb. 12, 1996, Pat. No. 5,830,378, which is a continuation-in-part of application No. 08/398,356, Mar. 3, 1995, abandoned, which is a continuation-in-part of application No. 08/299,474, Aug. 29, 1994, Pat. No. 5,564,235.

[60] Provisional application No. 60/019,551, Jun. 10, 1996, and provisional application No. 60/022,443, Aug. 5, 1996.

[51] Int. Cl.[7] ..... E02D 27/00

[52] U.S. Cl. ..... 52/294; 52/169.12; 52/274; 52/293.1; 52/293.3; 52/299; 52/741.15; 52/742.14; 405/229

[58] Field of Search ..... 52/169.1, 169.12, 52/274, 292, 293.1, 293.3, 294, 295, 299, DIG. 3, DIG. 15, 741.13, 741.14, 741.15, 742.14, 745.02; 405/229; 249/50, 19

[56] References Cited

U.S. PATENT DOCUMENTS

| | | | |
|---|---|---|---|
| 2,144,700 | 1/1939 | Barnett | 52/293.1 |
| 2,200,636 | 5/1940 | Palmer | 52/293.1 |
| 2,743,602 | 5/1956 | Dunn | 52/274 X |
| 3,176,432 | 4/1965 | Doolittle, Jr. | 52/293.3 |
| 3,753,323 | 8/1973 | Nesbitt | 52/169.12 |
| 3,820,295 | 6/1974 | Folley | 52/270 |
| 4,263,762 | 4/1981 | Reed | 52/293.3 |
| 4,464,873 | 8/1984 | Geiger | 52/293.3 |
| 4,656,797 | 4/1987 | Marquart | 52/169.12 |
| 4,738,061 | 4/1988 | Herndon | 52/126.6 |
| 5,224,321 | 7/1993 | Fearn | 52/741.15 |
| 5,564,235 | 10/1996 | Butler | 52/294 X |
| 5,664,377 | 9/1997 | Angelo et al. | 52/292 X |

FOREIGN PATENT DOCUMENTS

| | | | |
|---|---|---|---|
| 743322 | 9/1966 | Canada | 52/169.1 |
| 1035172 | 8/1983 | U.S.S.R. | 52/292 |
| 2147635 | 5/1985 | United Kingdom | 52/292 |

*Primary Examiner*—Laura A. Callo
*Attorney, Agent, or Firm*—Bruce H. Johnsonbaugh

[57] ABSTRACT

A perimeter-wall foundation is created by attaching galvanized-steel corrugated panels to an in-place structure. The freely hanging bottom edges of the panels, which have continuous deformation specific to the enhancement of bearing and anchorage within concrete, are cast in-situ with footing concrete, so becoming a cast-in-place perimeter-wall foundation, capable of residential-scale bearing and shear loadings. The panels can have screened ventilation built into the top, utilizing corrugation flute apertures, or they can be thermally optimized for cold climates.

21 Claims, 4 Drawing Sheets

24
14
18
13
16
12
22
23

24
14'
18
12
22

28
54
17
12
17
18

14
13
26

11
10'
14
13
26
12'
11
46
50
48
50

42

38
40
52
12'
42
40
44

24
26
22
18
32
13'
34
20
30
36
16
12'

18
28
56
16
12

28
26
32
30
13'
11'
34
36
12
28
32
26
30
34
13'
36
12'
46
50
48
50

42

12
42
44
46

FOUNDATION FOR A MODULAR STRUCTURE

REFERENCE TO RELATED PATENT APPLICATIONS

The present patent application is related to predecessor U.S. provisional patent applications: Ser. No. 60/019,551 filed on Jun. 10, 1996, for a FOUNDATION FOR A MODULAR STRUCTURE, Ser. No. 60/022,443 filed on Aug. 5, 1996, for a THERMALLY ISOLATED PERIMETER FOUNDATION, both to the selfsame inventor Michael G. Butler who is the inventor of the present application.

The present patent application is also a continuation-in-part of U.S. patent application Ser. No. 08/818,497 filed on Mar. 14, 1997, for FOUNDATION FLOOR CONSTRUCTION METHODS AND DEVICES, now abandoned, which application is itself a continuation-in-part of U.S. patent application Ser. No. 08/600,408 filed Feb. 12, 1996 for CONCRETE SLAB FOUNDATION FORMING DEVICES, now U.S. Pat. No. 5,830,378, which application is itself a continuation-in-part of U.S. patent application Ser. No. 08/398,356 filed on Mar. 3, 1995 for CONCRETE FOUNDATION WALL FORMING DEVICES, now abandoned, which application is itself a continuation-in-part of U.S. patent application Ser. No. 08/299,474 for a FOUNDATION AND FLOOR CONSTRUCTION MEANS issued Aug. 29, 1994 as U.S. Pat. No. 5,564,235. All related predecessor applications are of the selfsame inventor Michael G. Butler who is the inventor of the present invention.

BACKGROUND OF THE INVENTION

1. Field of the Invention

The present invention concerns improved methods and devices for construction of permanent perimeter foundations and anchorage therefor, especially for pre-situated structures, such as mobile homes and modular housing.

The present invention particularly concerns a pre-hung corrugated steel wall panel that is cast-in-place with footing concrete thus creating a structural foundation wall. The relevant components and methods allowing this new use of the common corrugated panel material are also disclosed, as are embodiments of this foundation wall providing thermal efficiency, particularly for metal structures.

2. Description of Prior Art 2.1 General Background

Conventionally, perimeter foundation walls are built from the bottom up. After a site is prepared, the geometry for that foundation is typically created by careful measurement and the setting-up of strings which each define a face of the foundation. Then the foundation walls are built as close as practical to these string lines, while attention is paid to level and plumb, et cetera.

A procedure such as this is typically followed for a perimeter foundation of a prefabricated modular structure, which must subsequently be positioned upon that foundation. Unless a crane of suitable capacity is available, setting the modular unit(s) upon the finished foundation involves a difficult process of sliding, adjusting, lowering, fitting, blocking, and attaching. Quite often the foundation will have enough deviation in accuracy to cause problem with fit of the modular unit(s).

The use of corrugated panels, by themselves, as bearing walls is a practice known to be utilized in light steel building construction to a limited degree. Corrugated steel sheet-piles are common in earth-work as temporary or permanent load-bearing and retaining walls.

2.2 Specific Prior Art

This inventor's research has uncovered only one patent involving cast-in-situ bearing-panel foundation walls. U.S. Pat. No. 3,820,295, by M. Folley, June 1974, discloses the use of corrugated steel foundation walls cast into concrete, as part of a system for constructing a corrugated panel building. Inverted "T" sections of corrugated panels are set into a trench, then partially cast into concrete, and finally remain as foundation walls. These panel "T" assemblies are built of perpendicular (horizontal) panel elements attached along the bottom edge of the wall (vertical) panel elements with continuous gusset elements each side, by welding upon each flute of each corrugated element to each flange of both continuous gussets. Multiple holes are also placed in the gussets and the horizontal corrugated panels, apparently to help allow some flow of the concrete throughout the assemblage.

The "T" panels disclosed cause considerable and unnecessary manufacturing expense and storage difficulties, while presenting an obstruction to the placement of concrete within the confines of a trench. The continuous "T" element causes difficulty in the required pre-support of the panels by adding extra weight, requiring extraordinarily accurate or over-sized footing trenches, and especially because the horizontal plane presence will catch the concrete being placed so creating a devastatingly high load upon the temporary support to the panels.

It could be assumed that the intended general construction sequence is conventional, but no disclosure is given for a method of pre-situating the panels. This aspect of that invention's foundation is the most important because the panels would have to be cast in place exactly, straightly, and precisely where required to be of any use for the continuing construction of the building above, which is of pre-fabricated elements. In addition, the complications of the "T" base require that the pre-support also remain perfectly in place while under the very high loads of concrete placement. No adjustment or tolerance of significance would be possible after the panels are cast in-situ.

The Folley patent emphasis is on the unique construction above the foundation walls. Based upon the disclosure given, that foundation method appears to have not succeeded in construction practice, let alone provide cost efficiency.

SUMMARY OF THE INVENTION

The present invention involves a very efficient manner of constructing a perimeter-wall foundation. This method is extremely labor-efficient in that no effort of defining the geometry of that foundation-wall is required. Instead, the geometry of a foundation for a given structure is duplicated by simple attachment to that pre-situated structure. That pre-situated structure can be modular housing, mobile homes, proprietary floor systems, any type of a stay-in-place structural-member, or a removeable guide member.

1. Prefabricated Modular Structures

For the case of a pre-fabricated/modular structure, such as a mobile home, the unit(s) is set upon its own internal piers by conventional methods, such as utilizing stacked concrete blocks upon treated-wood or concrete pads. Then any number of variously-selected-height corrugated panels may be hung from the perimeter or interior of the unit(s) and so dangling partially into a trench, contiguously attached, along a location where is desired a foundation wall. The action of gravity keeps the panels vertical, then in-situ concrete is placed into the trench, flowing about the specially deformed lower edge of the panels. The panels are adjusted more finely to vertical before the concrete hardens, so creating a true foundation wall having superior anchorage to the concrete footing, with a minimum of effort and cost.

2. Site-Built Structures

For the case of a site-built structure, a linear element is pre-situated along a location of perimeter or interior line of support. The element can be initially supported by conventional means such as wood stakes, or by any suitable proprietary method. The element can be removable, or be a stay-in-place member such as a rim-joist. The method of casting-in-place the foundation wall panels is essentially identical to above, as is the result.

3. Thermal Isolation

For foundations of metal buildings in cold climates, this invention contemplates improvement of the thermal isolation in connection of the metal foundation-wall to the metal building-structure, whereby heat transmission from the metal structure to its foundation interface is minimized.

A common practice in metal building construction is to wrap exterior walls externally with a layer of insulating foam, and economic factors often dictate sheathing that foam with a stucco-cement product. This invention provides apparati and method for allowing this same cost-effective foam-wrap and sheathing method to occur on the foundation walls, while providing a barrier preventing capillary transportation up those wall layers, and where that barrier is also a screed (thickness-guide) for placement of that stucco-cement.

4. System for Variable Sites

For all embodiments of this invention, variable building heights and sloping sites can both be addressed by creating a system of panels of discrete standardized lengths, so that a panel length can be selected from this system which will suit the needs of varied foundation height at according to particular location, as the concrete footing can accommodate the resulting relative differences of adjacent-stepped panel extension into footing trenches. This standardization of lengths allows manufacture of a limited number of distinct parts to serve all foundation wall cases, within the height limits of that panel strength. To greatly facilitate the determination of panel lengths and quantities, especially for sloping sites, software is utilized which accepts building geometry and relative grade heights as input, and then provides panel location and quantity by length, as output.

5. Labor Savings and Improvement

This is a perimeter foundation which can be built without any: geometry definition, concrete forming, form stripping, foundation pony-wall framing nor sheathing. Besides missing all of these steps, the method improves: accuracy (by geometry-duplication), foundation anchorage to concrete-footings, strength and longevity (over conventional wood-framed ponywalls that rot and become eaten by insects), ventilation options, and thermal performance.

The present invention offers distinct apparati for connection of these structural panels to a given structure, to suit varied needs, yet the connecting element of any type can be avoided by notching out the top of each panel narrow flute, as is disclosed in this inventor's related predecessor patent application Ser. No. 08/818,497.

In summary, this foundation offers improved structure for less cost.

6. Specific Objects and Advantages

More specific objects and advantages of this invention include the following:

1. Provide a method allowing construction of the lowest cost permanent, continuous, perimeter foundation for a prefabricated modular structure or the like. This method allows construction of foundation walls which provide lateral strength and uplift anchorage that is superior to any other presently available proprietary method of founding modular structures.

2. Provide a structural foundation wall panel, which can be pre-hung from a modular structure, floor framing grid or the like, and then have its lower edge cast with in-situ concrete to permanently provide support and anchorage. This avoids the need to lay out, define geometry of, and construct a conventional perimeter foundation independently of the modular structure. With this method, the presence of the modular structure is utilized optimally to define the foundation geometry, and to hold structural elements in place until in-situ concrete affixes those elements permanently.

3. Provide the lowest cost method whereby grade backfilling can occur about the perimeter of a structure that is at or above grade. This allows installation of a modular structure to inexpensively be of a low-profile set, while diverting surface water from the structure.

4. Provide means and apparati for utilizing readily available decking panels, initially having normal factory straight-cut ends, for a new use as foundation walls. These foundation walls can be weight bearing panels, shear panels, or combination bearing and shear panels, without the need for any other foundation wall framing members or like structure for those same foundation walls.

5. Provide a combination structural-wall and visually-appealing-screen foundation panel that can be installed before any footing concrete is placed, thus avoiding any need to fit panels to planes dimensionally confined by previous concrete placement, and also providing superior anchorage of the panels to concrete.

6. Provide a method of ventilating an enclosed crawl space foundation having a perimeter of corrugated panels, without the need to place any penetrations in the foundation panels, particularly where the panels would suffer structurally from any ventilation penetrations. The object is also to place the vents are as high as possible, allowing backfill to be as high as possible, and so the building can be set relatively low.

7. Provide a screen apparatus for foundation ventilation that will provide consistent screening at the ends of the flutes of perimeter corrugated panels independently of the specific pattern of corrugation.

8. Provide a foundation screening apparatus combined with a device that connects a foundation panel to a structure.

9. Provide a pattern of deformation along the edge of an otherwise contemporary corrugated panel that optimizes the strength of the panel connection to concrete for a minimum amount of expense. Also the object is to provide a method of creating a deformation pattern that optimizes concrete connection strength and requires no apertures, and so can easily be field-created.

10. Provide a single, simple, quickly-installed component that can provide bearing wall, shear panel, and sheathing purposes, thus saving on material and labor costs for foundation walls, especially when of varied heights because of slopes, et cetera.

11. Provide the previously listed objects while also providing a method of thermal isolation at the structural connection with a supported structure, and/or in combination with surface insulation for the foundation wall itself.

12. Provide a combination waterstop/screed that defines thickness of a stucco type coating operation, and allows that coating to continue below a continuously damp finished grade, without fear of detrimental capillary moisture absorption to any stucco and/or foam insulation layers above.

13. Provide a prefabricated foundation wall panel that is ready to install at the perimeter of an existing structure, and becomes substantially thermally isolated from that structure and also from the exterior, thus reducing heat loss out of that structure.

14. Provide a prefabricated foundation wall panel connection apparatus to a structure above that creates a space between that structure and the panel itself, so increasing thermal isolation while also providing a continuous pocket for supporting any subsequently placed rigid insulating foam at the underside of that structure, with that apparatus also providing ample out-of-plane strength to resist subsequent loads from soil back-filled against said panel.

15. Provide a metal-foundation to metal-building connection that satisfies all structural requirements while simply and effectively minimizing contact area between the two entities, thus minimizing heat loss from the building with contemporary insulator material, so that thermally isolating products can become more cost-effective in isolating metal buildings by minimizing conductive heat loss at the foundation interface. Also these objects are gained with the additional provision of an insulation space between foundation and building.

16. Provide a metal-foundation to metal-building connecting element that satisfies all structural requirements while consisting solely of thermally insulating material, and where that same element can also provide insulation space between the foundation and building.

17. Provide a prefabricated-wall cast-in-place lateral-support-foundation-system where the lateral and uplift loads corresponding to a given building structure, are resisted solely by that system, and where that system consists, as part or all, of the perimeter foundation.

DESCRIPTION OF THE PREFERRED EMBODIMENT

1. List of Drawing Figures

Figures 1, 2, 2A, 2B, 3, 6:
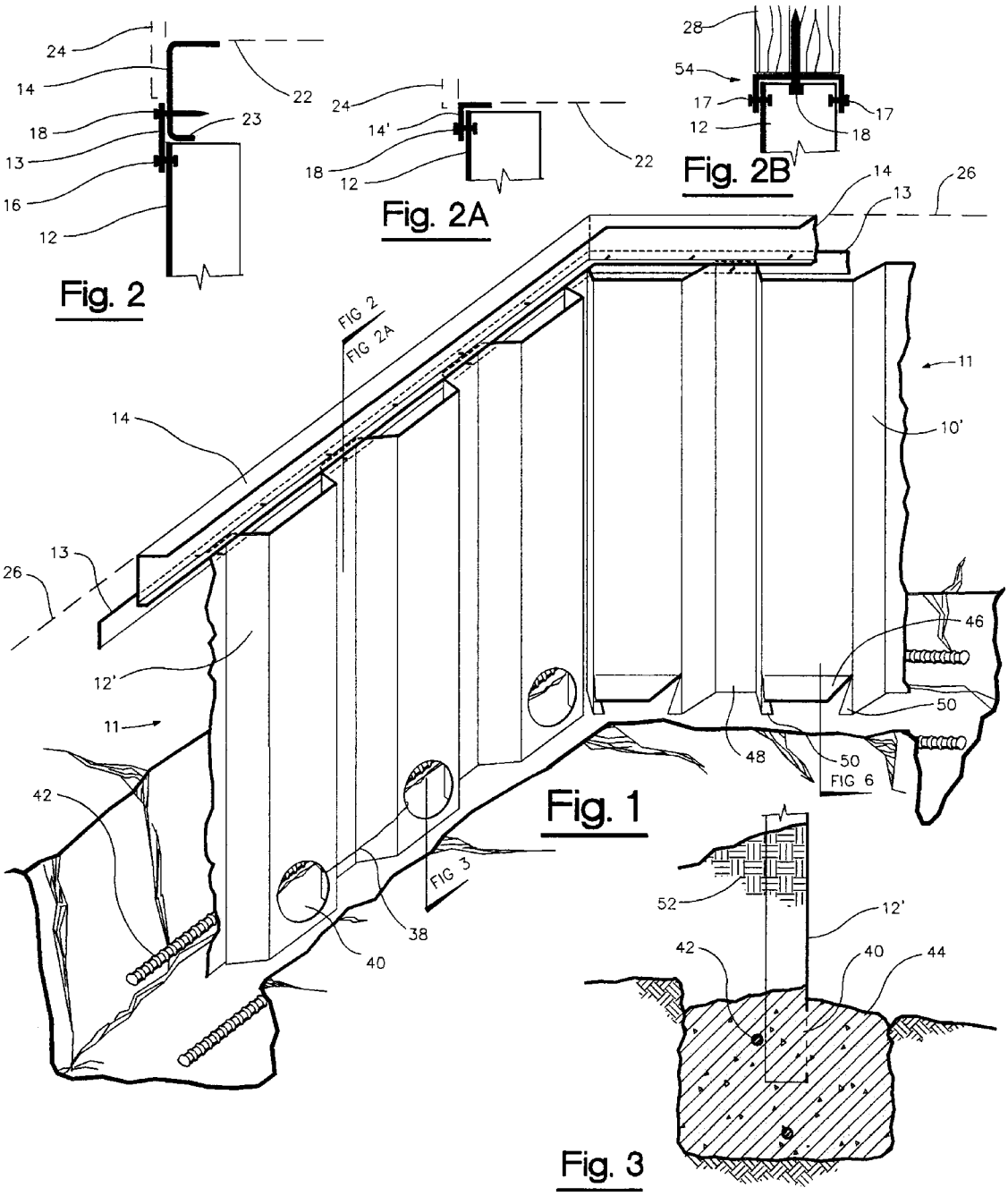

| | |
|---|---|
| 1 | Foundation Panels Ready for Concrete |
| 2 | Foundation Panel Connection to Steel Structure |
| 2A | Foundation Panel Connection to Steel Structure Directly |
| 2B | Foundation Panel Cap Connection to Wood Structure |
| 2C | Foundation Panel Cap/Strip Connection to Wood Structure |
| 3 | Footing with Concrete and Backfill in Place |
| 4 | Top-Screened Foundation Panels Ready For Concrete |
| 5 | Foundation Panel Connection to Wood Modular Structure |
| 6 | Footing with Concrete in Place, Tab Anchors |
| 7 | Cut-away View of Installed Foundation Wall Panel |
| 8 | Section at Panel/Structure Interface |
| 9 | Section at Panel/Footing Interface |
| 10A | Panel at Structure without Stucco Screed |
| 10B | Panel at Structure without Foam Space and Stucco Screed |
| 10C | Panel at Structure with Insulating Connector |
| 10D | Panel at Structure with Spaced Insulating Connector |

2. Reference Numerals in Drawings

| | |
|---|---|
| 11 | Foundation Panel Assembly |
| 12 | Corrugated Foundation Panel |
| 13 | Shear Strip |
| 14 | Pre-Attached Perimeter Channel on Modular Structure |
| 15 | Strip Connector Assembly |
| 16 | Fastener, Field or Factory Installed |
| 17 | Fastener, Factory Installed |
| 18 | Fastener, Field Installed |
| 19 | Screed/Waterstop |
| 20 | Bearing Channel With Keeper |
| 21 | Metal Perimeter Member of a Metal Structure |
| 22 | Bottom Surface of Modular Structure |
| 23 | Lower Flange (of Perimeter Framing Member) |
| 24 | Siding Material of Modular Structure |
| 25 | Rigid Insulating Foam |
| 26 | Line of Perimeter (of Pre-situated Structure) |

-continued

| | |
|---|---|
| 27 | Thermal Isolator Strip |
| 28 | Pre-Attached Perimeter Wood Nailer on Modular Structure |
| 29 | Field Floor Framing Member |
| 30 | Screened Shear Strip Assembly |
| 31 | Floor Panel |
| 32 | Bearing Channel |
| 33 | Wall Framing |
| 34 | Screen |
| 36 | Hem |
| 37 | Ledger Flange |
| 38 | Tie Wire, or Equivalent |
| 39 | Vertical Face |
| 40 | Large Aperture |
| 41 | Cover Flange |
| 42 | Reinforcing Bar |
| 43 | Stiffening Lip |
| 44 | In-situ Concrete |
| 46 | Tab Anchor |
| 48 | Flute Foot |
| 50 | Flute Foot Anchor |
| 52 | Backfilled Soil |
| 54 | Cap Channel |
| 56 | Cap/Strip Channel |
| 58 | Fastening Lip |
| 60 | Horizontal Flange |
| 62 | Return Flange |
| 64 | Stucco Layer or Similar |
| 70 | Polyethylene Vapor Barrier or Equivalent |
| 72 | Spline/Barrier |
| 74 | Thermal Isolator Bearing Strip |
| 76 | Thermal Isolator Strip |
| 80 | Strip Connector Assembly of Insulating Material |
| 82 | Structural Vertical Strip Element |
| 84 | Integral Thermal Isolator Bearing Strip |
| 86 | Strip Connector Assembly without Foam Space |
| 88 | Strip Connector Assembly of Insulating Material with Foam Space |
| 90 | Vertical Structural Web |
| 92 | Vertical Fastening Flange |
| 93 | Vertical Panel Fastening Flange |
| 94 | Horizontal Bearing Flange |
| 95 | Integral Screed/Waterstop Flange |
| 96 | Horizontal Bearing/Closure Flange |
| 98 | Closure Lip |

3. DESCRIPTION

Commencing in the drawings FIG. 1 a view of a foundation panel assembly 11 is shown from the interior of the foundation perimeter. The supported modular structure is removed for clarity.

Foundation panel assembly 11 is primarily made up of a corrugated foundation panel 12, with some type of component for attachment of panel 12 to a pre-situated element, such as a pre-attached perimeter channel 14 shown here. In this case the attachment component consists of a shear strip 13, which can either be continuous or of segmental lengths according to installation needs. For pre-attachment of strip 13 to panel 12, strip should be of lengths corresponding to panel widths. Break locations in segmental strips need not align directly with panel breaks, as overlap of the elements can be beneficial. These elements are described in detail below.

Panel 12 is a common galvanized steel corrugated decking panel such as those commonly used for roof decking or floor decking in building construction. The particular panel shown is a roof decking ("B-deck") panel such as is made by any of the commercial decking manufacturers (Verco, BHP, etc), having a 38 mm (1.5") corrugation depth, with corrugation pattern repeating at 152 mm (6"), and is typically made in 914 mm (36") panel widths. It is not essential that this particular choice of decking be used. It is commonly available at a very competitive price due to large existing markets, and this panel serves the typical structural needs of most perimeter foundations, and it has benefit to use as a ventilated foundation wall in its pattern of corrugation.

In use as decking, these panels are conventionally oriented horizontally, as utilized to support an in-situ concrete slab roof. The "B"-deck panel has an alternating series of relatively narrow ("bottom") and wide ("top") flutes designed for the purposes of optimizing deck concrete usage. This alternating pattern can be utilized to advantage as a foundation wall by either maximizing potential flute-ventilation area (described below for FIG. 4) in "bottom-out" orientation, or by maximizing surface support to a covering layer in "top-out" orientation.

FIG. 1 shows panel 12 orientated vertically, with flutes vertical, and with the "bottom" (from the perspective of conventional use as decking material) to the exterior. That is, the less-wide flutes are to the exterior, and the more-wide flutes are to the interior. Where panels are left physically exposed to the exterior, this "bottom-out" orientation also offers the advantage of avoiding any panel seam edges to the exterior, as in conventional decking manufacture they are turned toward the deck "top", which in this case is the interior (crawl-space).

Lengths (heights) of panel 12 are those to suit given projects, grades, and specific location along the perimeter. As the bottom edge of panel 12 is to be cast in concrete, the exact location of that edge can vary. Thus panels can be of standardized incremental (stepped) lengths to suit any specific grades (heights), as described in the invention summary above.

Most any corrugated panel design which is adequate for the imposed loads, will serve the purpose of this perimeter foundation structural wall panel, without the presence of any other foundation wall structure such as ponywall framing, if the flutes are oriented vertically as shown. For example, corrugated panels of symmetrical sinusoidal wave pattern can also be utilized perfectly well as foundation panels in the manner shown here. Also, the panels can be of any material and design (uncorrugated) so long as foundation structural requirements are satisfied. The material chosen as structurally cost-effective for our product development is ASTM A446 Grade A (hot-dip-galvanized coil-sheet-steel), where the yield strength is at least 225 MPa (33 KSI). Most of the manufacturers of "B-deck" typically provide it with a yield strength of 258 MPa (38 KSI). A galvanizing of the standard "G-90" zinc weight, as opposed to the more common "G-60", is preferred for the materials of panel assembly 11 installed in damp environments.

For modular housing units imposing significant gravity loads as well as lateral loads, steel panel 12 is typically of a thickness of 1.10 mm (18 gage) or as thick as 1.44 mm (16 gage) material. For manufactured homes built to the Department of Housing and Urban Development Code (HUD Code), commonly referred to as "mobile homes", which are primarily supported along the interior chassis, panel 12 at the perimeter would then be subject primarily to lateral loads with only relatively minor gravity loads, or possibly roof snow loads. It could then be as light as about 0.720 mm (22 gage), depending upon specific lateral load, any soil retaining forces, snow loads, and geometry factors.

Panel (and connection components) 11 exterior surfaces are best protected, in addition to the galvanizing, by an application of roofing tar (room temperature or hot), or water emulsified coal tar, or the like. The tar can be field applied, or the panels can be factory coated. An immediately placed, subsequent covering of sand, can provide inexpensive texture finish as it binds into the tar. The combination of these two provide long term protection of the panel combined with an aesthetically pleasing, UV resistant, foundation wall finish. Any color of paint can of course be applied over. Alternatively, any compatible texture/paint product can be applied over the cured tar.

Panel 12 is best made in incremental heights (lengths) for reasons described below, starting with a practical minimum height of very roughly 300 mm (12"). Individual panel width is not crucial, it can be an industry standard for roof decking panels such as that of 900 mm (36"), thus providing the benefits of conformity with presently available material.

Analysis of the structural properties and buckling strength of this type of decking can be quite complex, considering the combination of loadings as: a bearing wall, a beam element from out-of-plane loads such as those by retained earth, and in-plane shear loads. Decking panel testing performed at West Virginia University for combined wall-bearing parallel to the flutes and out-of-plane loadings, have shown that the specimen follow theory closely enough to confirm validity of structural formulae developed by the American Iron and Steel Institute (AISI) which have been adopted by the model building codes. The shear force within the limits of building-code-approved decking shear-strength tables can be safely superimposed, as the shear-action within these limits contributes very little to overall element stress for panels of this type. The 1.14 mm (18 gage) "B-deck" panels have a code-allowed shear-strength (while under maximum flexure) of approximately 1400 Kg force per running meter (1000 PLF), which is about four times that of common plywood shear panels that are conventionally placed upon conventional wood-framed foundation ponywalls.

Presently the structural safety of for this new use of these panels has been justified by extensive calculation based upon the AISI formulae. The strength of the panel connection and the concrete footing itself is justified by similar calculation based upon known properties of concrete. A simple calculation for the bearing strength of the panel at the footing follows. It is included to show that the panel with the simple deformation pattern disclosed is adequate for residential scale bearing loads without the need for some sort of an attached horizontal element such as Folley's "T" described in "Prior Art" above.

FIGS. 1 and 6 show that panel 12 has a series of a tab 46 which is created by two cuts made from the bottom of panel 12, and at diverging directions so that each tab has two tapered sides. Before the placement of concrete, tab 46 should be bent out-of-plane with panel 12 by at least very roughly about 5 degrees, but preferably about 45 to 90 degrees, for reasons discussed below. The divergence of the cuts creating the taper of tab 46 allows panels to stack after tabs are bent. More importantly, the divergence of the tab cuts provides a remaining flute foot 48 with two of a flute foot anchor 50 where each anchor 50 has an edge with the reverse of this same taper. This resulting reverse taper of each anchor 50 provides excellent withdrawal strength for each cast-in-concrete flute foot 48. Our development has shown that a 5 degree taper on these cuts serves well for both anchorage and panel nesting, but this angle can vary considerably for both purposes.

The series of tab 46 provides support to bottom extent of panel 12 for downward vertical loads. Considering that in this loading condition, a resulting compression zone of concrete can be considered to have an upper boundary, each side of the loading element, sloping at 45 degrees downward. Thus tab 46 best serves bearing purposes when bent at least 45 degrees so as to remain at the top of this compression zone, but when bent over 90 degrees tab 46 would impart a lateral component contributing to a possible longitudinal the cracking of the concrete. Given that in-situ concrete is can be considered to be of at least 13.6 MPa (2000 PSI) design strength, each approximately 38 mm×80 mm tab can bear about 800 Kg force (1800 lb), if only 20% of the bearing area is considered effective (that nearest the panel plane). This equates to 2650 Kg force per running Meter of perimeter (3600 PLF). Soil/footing design loading is typically a third of that for residential construction, so this panel deformation pattern is clearly adequate for residential-scale bearing-wall loads.

Continuing in the drawings FIGS. 1 and 3, alternatively, panel 12' connection to subsequently placed in-situ concrete can be enhanced with a series of a large aperture 40, in lieu of the series of tabs and feet described above. Aperture 40 must be of adequate dimension and repetition to allow the bond of concrete to occur across panel plane, thus providing a stronger anchorage to footing. Round holes are best of a diameter that is nearly half that of their spacing, in order to provide adequate concrete bond. This frictional attachment to the concrete footing is considerable (and is ignored in the informal loading calculation above).

Simple-cut-edge panels (FIG. 4) can be shown to have adequate bearing and uplift strength in the concrete footings in many situations.

A length of reinforcing bar 42 can be secured adjacently to panel 12' with a wire tie 38, or the like. Tie 38 can be secured around a flute via apertures 40. For panel 12, rebar can also tie to flute foot 48 via the diverging cuts discussed above. Again, this divergence helps, in this case by keeping tie 38 from slipping off foot 48.

The shear connections between adjacent panels can be the conventional steel-decking male-female seam connections, and so are not shown here. It is worth noting that conventional welded connections are best avoided here in that corrosion would be promoted at those locations. Also, foundation-wall panel access/orientation circumstances can make conventional "button-punching" of the male-female seams more difficult than it is for the conventional (horizontal) configuration of the decking. Alternatively, common panel male-female seam connections can be simply inserted, but left uncrimped, where shear loading requirements will allow. An optimal shear interconnection for foundation-wall utilization of the panels is that made by use of an appropriate adhesive placed along the male-female seam connections. This adhesive can be most any common "construction adhesive" compound, or an urethane type adhesive-caulk, or like compound which adheres to sheet steel. This type of panel interconnection can seal one or both panel edges (ungalvanized) from potential atmospheric corrosion, and can prevent possible moisture intrusion through the foundation wall at the panel seams.

Panels can of course simply be overlapped, and just fastened together if necessary, such as is commonly done with sinusoidal-pattern corrugated-roofing material. To accommodate this type of panel lap, pre-attached connector strip 13 must of course be appropriately shorter than the panel 12 to which it is connected.

Continuing in the drawings, FIGS. 1 and 2, panel 11 connects along a line of perimeter 26. Perimeter 26 can be the outer perimeter surface of any pre-situated object, such as: a modular structure (built per Model Building Codes), mobile home (HUD Code), proprietary pre-situated floor grid (such as the present inventor's U.S. Pat. No. 5,564,235), or any other object that physically defines the geometry of a building perimeter, where that geometry can be exploited directly to physically define the perimeter of a supporting foundation. Element 26 can be a single board, positioned as would be a first form-board in the construction of conventional foundation wall forms, with the difference here being that this board is the only one necessary to situate, and it can subsequently be left-in-place to become a permanent floor-framing-member such as a rim-joist.

Shear strip 13 is a galvanized steel strip of about 1.44 mm (16 gage) or the like that serves the purpose of attaching panel 12 to a pre-attached perimeter channel 14. The profile of channel 14 can vary considerably from that shown here, while the same concept of attachment of panels remains. Where a lower flange 23 of channel is less wide than panel 12 is thick, ventilation into the crawl-space is possible through the tops of the panel flutes, and so a continuous screen can be inserted between panel 12 and flange 23 at panel installation, if desired, similar to the screen arrangement (shown in FIGS. 4 and 5). If ventilation is required where flange 23 is wider than panel 12 is thick, appropriate description follows below (for FIGS. 4 and 5).

Bottom flange 23 can also be considered the bottom of any like perimeter element. It can be the bottom edge of a wood nailer that is often found at the perimeter of wood-framed mobile home undersides, or the bottom edge of the rim-joist described above.

Continuing in the drawings FIG. 2A, shear strip 13 or the like can be avoided if a perimeter channel 14' or the like, with a simple vertical flange, is utilized at pre-situated structure perimeter 26. Channel 14' can be field installed to a typical modular structure in lieu of strip 13, or it could be factory installed by a modular manufacturer in lieu of channel 14 or nailer 28 in anticipation of this foundation installation.

Continuing in the drawings FIG. 2B, an example of a cap channel 54 is shown. Cap 54 is typically of about 1.44 mm (16 gage) thickness galvanized steel. It can be factory connected to flutes each side of panel 12, and so would be of a length slightly less than each panel. Cap provides bearing surface area for wood structures, and a means of attachment from below.

Figures 2C, 4, 5, 6:
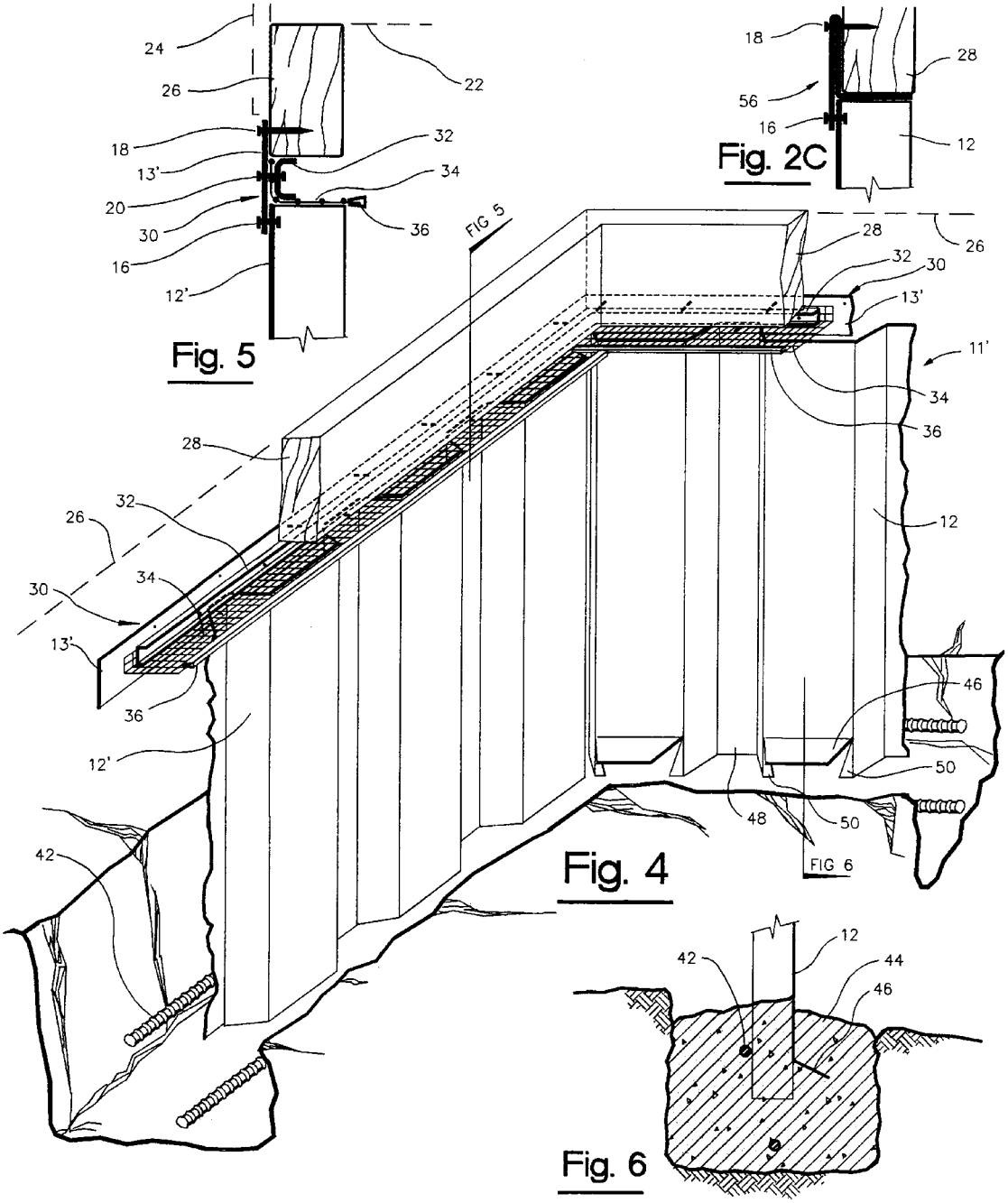

FIG. 2C shows a slightly more involved cap/strip channel 56, which is otherwise like cap 54. This is one version of the many possibilities for simple folded steel members which connect panels to building structures while providing bearing, shear transfer, and uplift load requirements.

Continuing in drawings FIGS. 4, 5, and 6, a panel assembly 11' with continuous top ventilation built-in, is shown.

A pre-attached (factory attached) perimeter wood nailer 28, which is common to most wood-constructed modular-structures, is shown above a vented foundation panel assembly 11'. Any pre-situated member can substitute for nailer 28 for this embodiment of panel installation. Assembly 11' includes a screened-shear-strip-assembly 30 along the interface between panel 12 and member 28.

Screened assembly 30 is of a bearing channel 32, a shear strip 13', and a screen 34. Assembly 30 can be field-attached or factory-attached to panel 12. For any pre-attachment, any length of assembly 30 must be less than panel 12, for convenience of installation. Bearing channel 32 is a cold-formed galvanized-steel section or the like. It provides a bearing surface for nailer 28 and creates a space, approximately 18 mm (¾") high, between nailer and top of panel 12, allowing ventilation to occur via the vertically oriented flutes of panel 12. A continuous vent slot is so created, which would otherwise be choked off by presence of nailer 28.

Bearing channel 32 upper flange can be made wider than the bottom flange, so that flute-ventilation area is decreased less by the channel presence, while bearing area presented to nailer 28 is increased. If an asymmetrical channel design is chosen, the effects of resulting eccentricity must be considered in the design of connections to panel 12 and to nailer 28.

A screen 34 can be utilized to prevent vermin access to a crawl space foundation via the vents created by the flutes in panel 12. Screen 34 can be galvanized or plastic. A heavily galvanized version has an advantage in that the presence of the extra zinc will create a field of corrosion protection for the cut edge of panel 12, although this edge is best protected with at least a spray-coating of zinc-rich paint anyway. Screen 34 is best attached to strip 13' by placing it between strip 13' and channel 32, as strip is factory attached to channel with a series of a rivet 20, or metal-deformity press-connections such as the "Tog-L-Loc" patented metal joining system, registered trademark of the BTM corporation of Marysville, Mich. Any other appropriate factory-made connections can of course be considered, for this or other panel assembly attachments.

Screened assembly typically comes in convenient lengths for field installation of panels 12, and can be a length corresponding to each panel width, aligning with panel seams, and with appropriate end clearances, so that each panel assembly 11' can be installed as a unit, contiguously. Alternatively, assembly 11' segment joints can stagger, that is, strip 13 joints can exist offset of panel 12 seams, while channel 32 joints align with panel 12 seams. This allows benefit of shear strip 13 overlap while avoiding detriment of bearing channel 32 extension, which if present, must be considered to have to be inserted between the previous panel top and member 28. Irregularities of member 28 and the previous-adjacent panel installation make this insertion potentially impossible.

Screen 34 can have a hem 36 that provides linearity and weight, thus keeping screen consistently close enough to flute ends to serve its purpose. Alternatively, screen can have a fold, and this fold can have an upward bend of very approximately 12 mm high which serves to hold up any sagging plastic vapor barrier which may be factory-installed underneath a manufactured home, thus preventing potential blockage to perimeter vent area.

Figure 7:
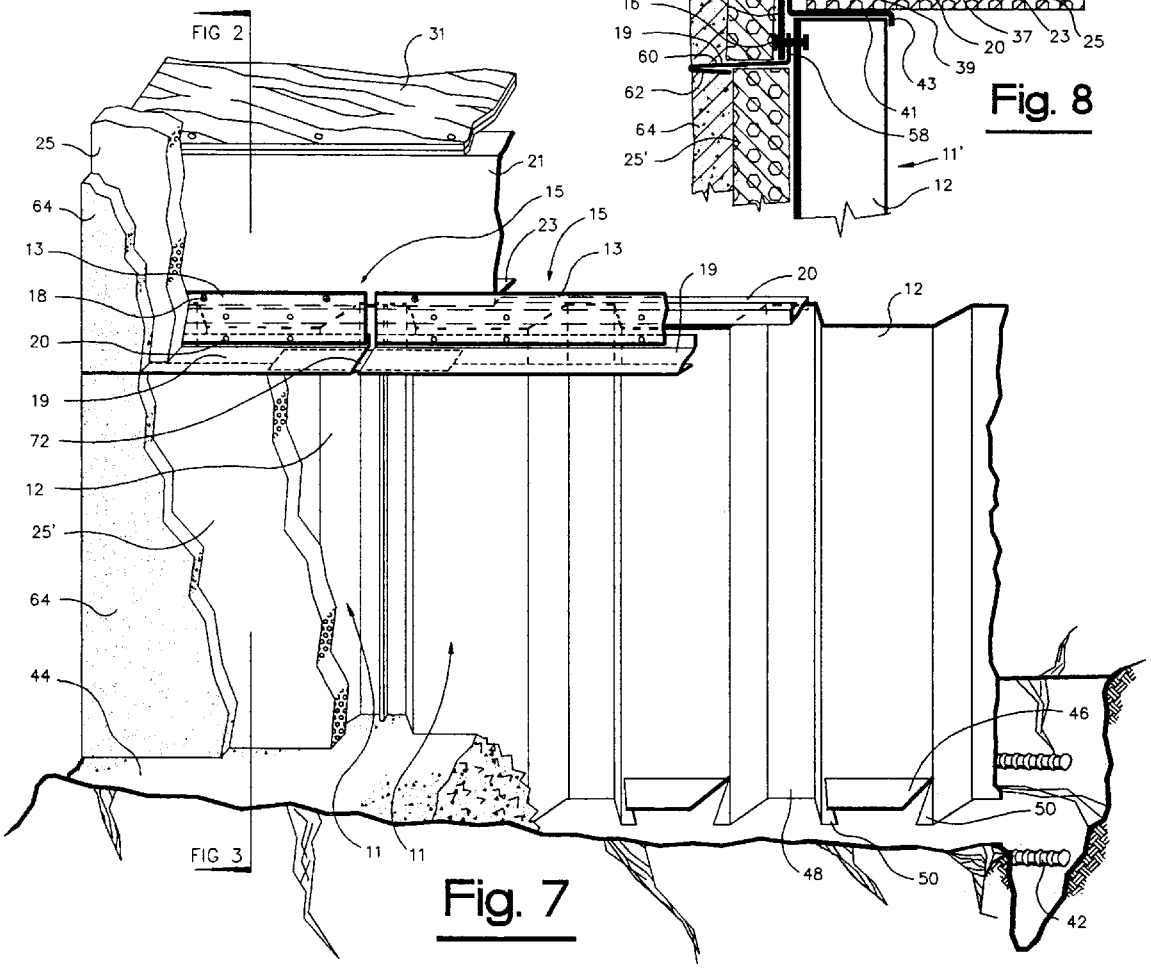

Continuing in the drawings FIG. 7, a view of perimeter foundation panel assembly 11', of an embodiment designed thermal efficiency, is shown from the exterior.

This panel assembly 11' is of corrugated foundation panel 12, as described for FIG. 1, with a special strip connector assembly 15 attached along the top edge. This panel 12 orientation differs from that of previous figures in that the decking panel 12 is shown "top" side out (from the perspective of the use as decking material). This orientation simply offers more flat steel surface for the support of surface coverings, as could be utilized to optimize thermal performance. This orientation is not critical, nor is the use of this particular type of panel, as described for FIG. 1. The point is that many variations in panel configuration will serve the purposes of the cast-in-place structural panel and its thermally efficient embodiments.

With present material technology, panel 12 is structurally most cost-efficient if of (heat conducting) steel, thus avoidance of thermal bridging at strip 15 is certainly warranted for metal buildings to prevent heat loss in cold climates. For wood structures, the thermal isolation features at the foundation panel 11 connection are probably not necessary, but the thermal insulation from the exterior to the crawl-space, and the labor minimization and other design efficiencies of this system still pertain.

FIG. 7 and FIG. 8

Panel 11' is shown attached to a metal perimeter member 21 of a pre-situated metal structure. The perimeter member 21 shown here specifically is a light gage, approximately 1.44 mm (16 gage) thick, steel channel or "track" section that is at the periphery of a pre-situated floor grid system. This perimeter member 21 can vary considerably. A field floor-framing member 29 is covered with a flooring panel 31. Some type of a wall framing 33 typically attaches along the perimeter.

In an ideally thermally efficient embodiment, panels are sheathed with a rigid insulating foam 25, such as polystyrene bead or isocyanate or any other suitable type, which subsequently is covered with something such as a stucco layer 64 for weather and moisture protection. For foundation-walls below-grade at wet sites, foam 25' can appropriately be sub-grade quality, such as closed cell urethane, extruded polystyrene, or the like. This type of a foam and stucco-product finish of course provides optimum protection and insulation for the foundation wall. It is cost-effective to stucco-sheath here if a stucco type covering is to be applied over the structure exterior anyway. Foam is conventionally installed in this manner over the exterior of metal framing in cold climates. Stucco lath wire and its attachment to thin steel is a contemporary practice, the only variation here is that foundation wall stucco lath is attached to panel 12 rather than to wall studs as above. This conventional stucco wire attachment is not part of this invention, and is not shown here for clarity.

Alternatively, the insulated panels can be of contemporary structural-insulated-wall-panels manufactured with outer laminations of metal and with expanded foam inside. These panels are commonly made with relatively minor surface fluting or even flat.

Figure 9:
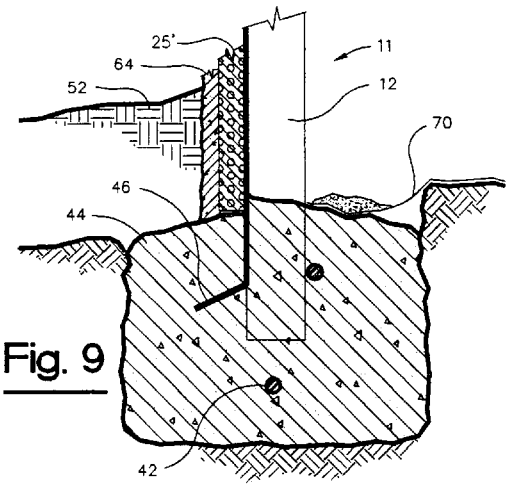

Of course where a crawl-space is thermally insulated from the exterior, venting should be omitted or at least controlled. Minimal vent openings which are automatically controlled to close during cold temperatures is a conventional construction technology which is beneficial to the present foundation designs. The presence of a vapor barrier 70 on grade (FIG. 9) is generally a necessary element to any thermally-controlled crawl-space design.

If foundation wall is to have other finishes, or no finish or insulation at all, is given to panel 11, then thermal isolation at panel connection to structure above becomes more important in cold climates.

Panel 11 is best made in incremental heights (lengths) and is connected as described above for FIG. 1.

Figure 8:
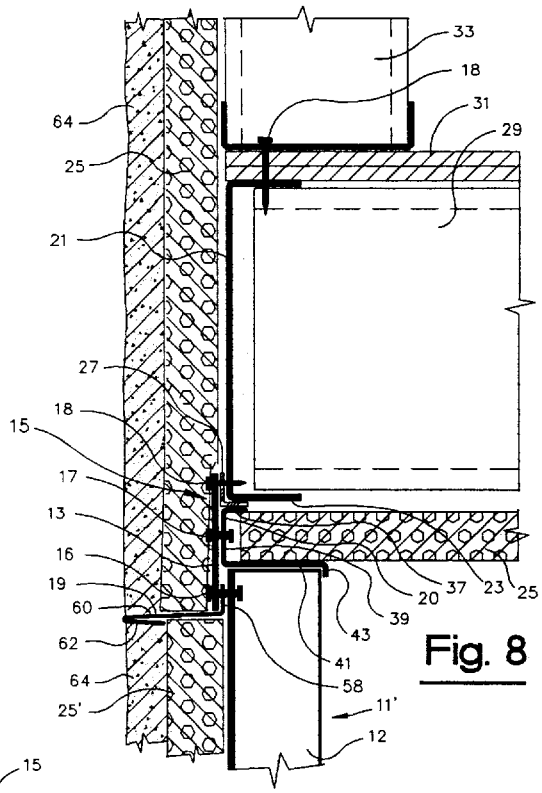

Strip connector assembly 15 can vary in construction. The embodiment shown in FIG. 7 and FIG. 8 is made up of four primary elements: the shear strip 13, a bearing channel 20, a thermal isolator strip 27, and a screed/waterstop 19.

Strip 13 is of 1.44 mm (16 gage) galvanized steel such as type ASTM A446 with a yield strength of 340 MPa (50 ksi), or the like, depending upon specific load and force considerations discussed further below. Strip 13 must be of a width that spans any distance between panel 12 and flange 23 and allows overlap with panel 12 minimally sufficient for the connection of a (field or factory installed) fastener 16, and overlap at perimeter 21 minimally sufficient for the connection of a field fastener 18. Each of these distances should be approximately a minimum of 12 mm (0.5") for the practical considerations of making connections.

Bearing channel 20 is appropriately of 1.44 (16 gage) or 1.81 mm (14 gage) thickness galvanized steel of similar quality to the other like components, but again thickness and strength requirements will vary according to geometry and loads, discussed further below. Bearing channel vertical face 39 is of a dimension necessary to create a space below perimeter 21 for rigid insulating foam 25. Foam is of a thickness necessary for underfloor insulation for given circumstances, with or without any batt insulation between floor framing members (With underfloor foam 25, thermal conductance through metal framing members is not significant). Face 39 does have a maximum practical height which will vary considerably according to loads. A height of approximately 25 mm to 40 mm (1" to 1.5") suits underfloor foam insulation requirements and is generally structurally feasible.

Ledger flange 37 is of a minimum practical dimension that allows suitable bearing of structure above. This minimum dimension is roughly 10 mm (⅜"), depending upon size and weight of structure above, as well as the choice of material for isolating strip, due to its variations in bearing capacity, cost, and thermal efficiency. The practical considerations of this dimension, and that of the overlapping fastening edge of strip 13, are those related to the field installation of the panels under imperfect site conditions by potentially hasty workers.

A cover flange 41 is dimensioned to bear upon the top edge of panel 12 of given manufacture. Lip 43 acts to support the inside surface of panel directly, from out-of-plane loads, such as soil backfill 52. This reduces fastener 16 prying and tension force criteria at panel somewhat and deformation to panel 12 of a given weight from given loads, allowing lighter weight panel selection. These out-of-plane loads cause significant shear force to fastener 18, due to cantilever geometry of assembly 15. Thus panel assembly 11 fastener installation, quantity of fasteners, and bearing strip strength, must take out-of-plane loads into account. Lip 43 does not reduce tension force at fasteners 16, connecting strip 13 to bearing channel 20, thus the criteria for amount and location of fasteners 16 that connect strip 13 to bearing channel 20 depend upon this out-of-plane loading. Two horizontal rows of this fastener would be justified for a given height of channel 20, the amount of out-of-plane load, and bearing channel thickness, et cetera.

Figure 10A:
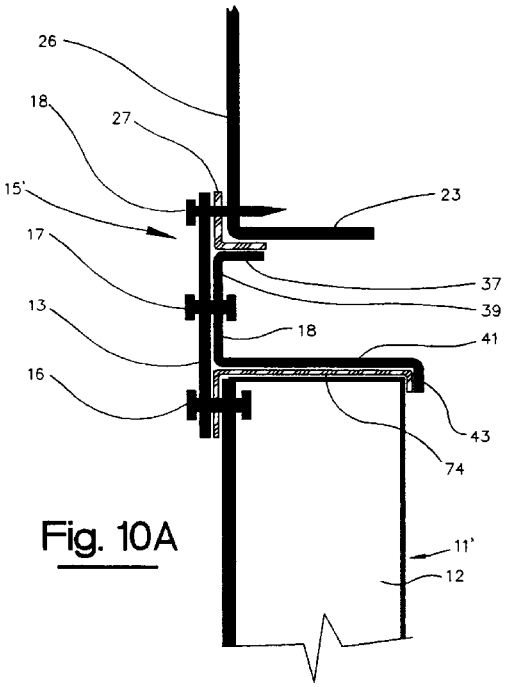
Figure 10B:
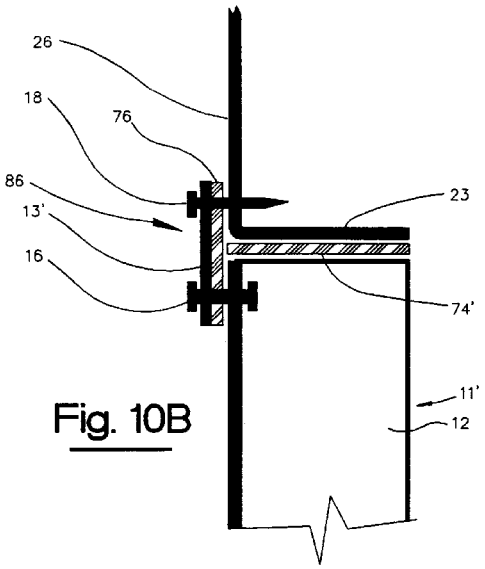
Figure 10C:
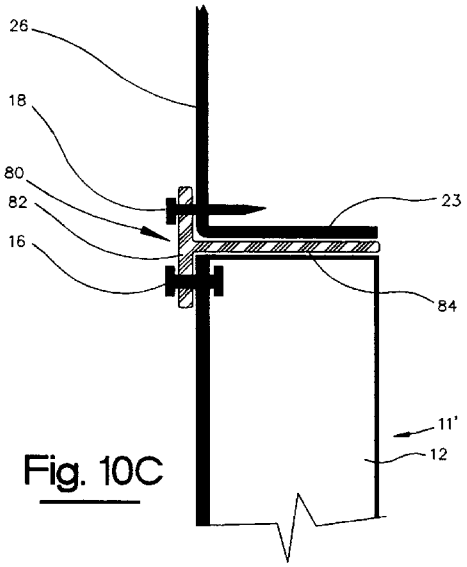
Figure 10D:
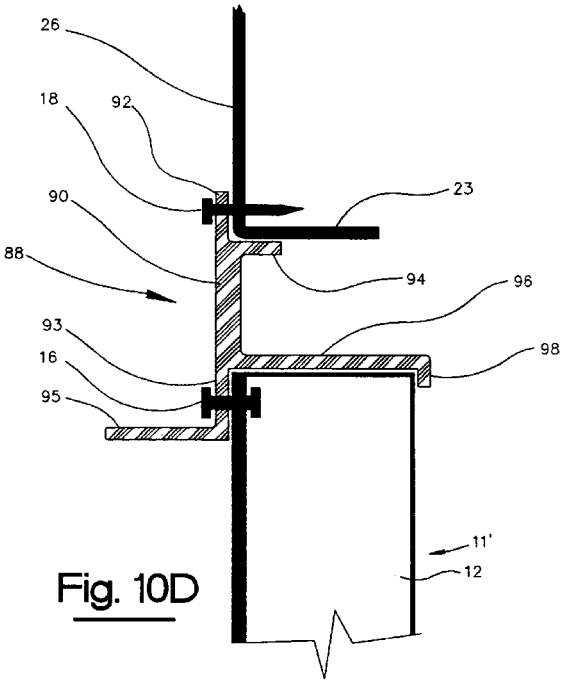

A more detailed discussion of the structural considerations of these connections and of the vertical column aspect of strip 15 follows below in the description of an insulating plastic connecting strip of FIG. 10D. These somewhat subtle structural considerations are more significant for a relatively expensive insulating plastic material structural element, than they are for relatively inexpensive and stronger steel structural elements.

The combined contact area to structure perimeter 21 of both strip 13 and ledge 37 must be minimized to reduce the surface area that must be thermally isolated, thus minimizing both conductive and radiant heat exchange for a given expenditure in relatively expensive isolator material.

Isolator strip 27 can be one of many materials, each having some tradeoff with regard to cost and efficiency. The actual isolating material is not part of this invention. The present invention discloses a structural foundation wall connection design that minimizes contact area with a metal structure, thus giving the opportunity to cost effectively use relatively more expensive materials as isolators. It is anticipated that many technological breakthroughs in the field of thermal isolators are impending, and that widespread commercial availability of highly efficient such materials will soon follow. Heat loss is proportional to this contact area, for any type of insulating material, so this invention has improvement in use with more common, less efficient isolators.

For situations where the supported structure does not impose tremendous concentrated bearing loads at any point along the perimeter, isolating strip 27 can be of an adhesive foam strip, or possibly two strips for ease of installation, one along ledge 37 and one along strip 13. Isolating strip 27 can be of relatively high density (50 shore A) closed cell vinyl foam such as 3M™ 4500 series foam tape which has minimal water absorption properties. This is a relatively economical isolator. It has a conductivity (u) of 0.043 W/m*K, which is about one thousandth the conductivity of steel at 46 W/m*K, and so it presents a virtual "brick wall" to conductive heat loss through the steel structure. A thickness of 3 mm (0.125") presents an R value of 0.41 $ft^2$*F*h/Btu, which is low compared to fiberglass batt insulation of a few inches thick, but the area presenting heat loss is very small. Where this juncture is within a perimeter-insulated controlled-vented crawl-space, the temperature difference between the steel elements is rarely going to exceed about 20 degrees Fahrenheit, so the heat loss is less than is for a 230 mm (9") wide strip of R20 insulated exterior wall assembly at a 40 degree Fahrenheit temperature difference. Thus the total heat loss through the foundation can be shown to be relatively minimal, even utilizing low-cost isolators.

Controlled-vented crawl spaces are typically minimally vented with heat-sensitive shuttered vents that remain closed during cold periods to avoid heat loss. This type of vent can be utilized with this crawl space foundation, by making an appropriate vent installation at a penetration in panel 12 where necessary.

The nature of structure perimeter 21 and panel 11 interface is such that concentrated loads are spread out over long lengths of perimeter, so that a fairly compressible isolating strip 27 can be utilized at ledge 37 typically, without concern about effects of isolator "bottoming out" from concentrated loads. Each field fastener 18 would typically be capable of roughly 1 kN of shear through vertical face of isolator 27, and thus can generally be expected accommodate the gravity loads in shear. The compressibility, or stiffness, of isolator should be such that it will start to take up relatively large downward loads well before fastener 18 connections start to fail, considering that some amount shear-slip will occur at the fasteners 16 connecting into ductile steel through the thickness of a soft isolator.

Presently available firm-hardness isolator materials include: polyvinyl such as contemporary vinyl windows and vinyl stucco-screeds are made of; "tire inner-tube rubber" or the like; silicone-treated ceramic fabric tape (such as 3M™ Nextel™ 312 fabric of Alumina-Boria-Silica); and silicone-treated fiberglass tape, about 3 mm (0.125") thick. Because the isolator can get wet during construction, and will frequently be at the dew point in damp climates, water absorbing materials must be avoided. The silicone-treated ceramics and fiberglass fabrics are more costly for a given amount of thermal isolation and insulation, but they allow far higher bearing force without detrimental compression.

Screed/waterstop 19 is of non-heat-conductive material which can provide enough structure to withstand the stucco-type finish process while remaining adequately true to act as a screed. Polyvinyl (such as UV-resistant rigid reinforced PVC extrusion) sections are commonly utilized for stucco screeding presently; and, either that or a pultruded UV-resistant glass-fiber-reinforced polyester-resin section will work here as well. Screed 19 also serves as a waterstop that breaks capillary and hygroscopic moisture transportation within either foam 25' or stucco, and along foam-to-stucco interface. Capillary transportation will not occur as greatly at foam-to-panel interface, because panel 12 contact with foam 25' is intermittent. However, setting screed 19 in caulk or tape at panel 12 surface will terminate any upward capillary action at the foam-to-panel interface, which may still be present at screed height.

Screed 19 has a fastening lip 58 that is kept in place by the factory connection of strip 13 to panel 12 and so serves to thermally isolate panel from strip 13. A horizontal flange 60 is of a width matching combined foam and stucco thickness, as its outer edge physically defines the stucco surface plane. An optional return flange 62 is of a width that returns back to outer surface of foam 25', to hold top edge of that foam in place, thus aiding installation. Return 62 also acts as a keeper for a spline/barrier 72, which is of similar material as screed 19, but sufficiently slender to fit within screed return. Spline is preferably less than about 1.5 mm thick, but this depends upon inside radius of horizontal flange 60 to return 62 "bend". Spline 72 serves to keep each screed 19 aligned to the adjacent other at panel 11 joints. Spline 72 substitute-performs screed 19 waterstop function at panel joints, and so preferably is of a width that fits fairly snugly to panel outer flute face.

Screed 19 can be field-installed, as can the entire insulating assemblage, to improve panel nesting and space requirements until installed.

The heat loss via conduction through the metal fasteners located along either edge of strip 13, while difficult to calculate, will certainly contribute significantly to the amount of heat transfer through isolator 27. A solution to this loss is to replace the composite-element strip 15 with an element consisting solely of insulating-structural material, as is discussed below for FIGS. 10B through 10D.

FIG. 7 and FIG. 9

The bottom of panel 11' has a deformation pattern along its bottom as described for FIG. 1.

A subsequently-placed backfilled-soil-material 52 is shown at the exterior side of the foundation wall (FIG. 9), for the site drainage, aesthetics, and thermal insulation to the footing. Subsequently placed polyethylene vapor barrier 70 is show over the soil at the inside of foundation wall to limit moisture vapor introduction from earth to the interior of a controlled vented, or unvented underfloor foundation space. Barrier 70 is sealed along edges with sand, or the like. Neither backfill 52 nor barrier 70 are necessary elements of this invention (although many building jurisdictions require the vapor barrier for a controlled-vented crawl space).

A length of reinforcing bar 42 can be secured adjacently to panel 11 with a wire tie, or the like, about top of foot 48. Tie wire not shown here for clarity.

FIGS. 10A through 10D show other embodiments of thermally isolating strip connector assembly 15 and the like. Features differing to the preceding are discussed.

FIG. 10A

The modified strip connector assembly 15' is for applications where a stucco finish is not being used, and so has no screed 19 (FIG. 8). Strip assembly 15' does have a thermal isolator bearing strip 74 at panel 12 to bearing strip 20 interface. Isolator 74 can be of identical material that isolator 27 is of, except that isolator 74 location at the cut ends of panel 12 is a consideration for tear resistance. The row of fastener 16 can be made strong enough to transfer all of gravity perimeter 21 gravity load to panel 12, if necessary. If panel 12 is not to be covered with foam or even cladding, then isolator 74 serves to seal bearing channel 20 to panel 12 joint from infiltration where necessary. Also, isolator 74 becomes that much more necessary in addition to isolator 27, due to greater temperature differences at this interface without the insulation or even cladding over panel 12.

FIG. 10B

Where a recess for supporting foam is not necessary nor desired, a strip connector assembly 86 without foam space is appropriate. Assembly 86 consists of: shear strip 13' (which is of a lessor width due to the lack of a foam space); a thermal isolator strip 76 that matches strip 13'; and a thermal isolator bearing strip 74' that matches panel 12 pattern thickness.

Isolator 76 can pre-adhere to strip 13' for convenience. Bearing isolator 74' has further concern about localized stress and tears than isolator 74, due to specific floor framing members potentially pressing flange 23 downward at particular locations. In addition, isolator 74' is acting alone without the benefit of the foam space and isolator 27 above. For these two reasons, isolator 74' should be more substantial than isolator 74, and in most cases can not be of solely a soft foam type product. Isolator 74' is suitably of a solid polyvinyl material of least 3 mm (0.125") thick, or the like. A hard rubber product will seal off air infiltration at the top of panel flutes.

FIG. 10C

To effectively eliminate heat conduction from the row of fasteners 18 to the row of fastener 16, a strip connector of insulating material 80 is utilized. Strip connector 80 replaces both strip 13' and isolator 76 with a structural vertical strip element 82, and it replaces bearing strip 74' with an integral thermal isolator bearing strip 84. Strip element 82 and bearing isolator 84 do not have to be integral as shown, but can be each of separate extrusions and of different materials. If integral, isolator 84 is physically kept in place at the top of panel 12 before panel installation. Integral connector 80 is appropriately of high quality RPVC extrusion, or of construction-structural quality glass-fiber-reinforced plastic pultrusion such as Extren® by Ryerson Steel Inc. of Chicago, Ill. In either case, connector 80 must be of a high enough connection strength to satisfy requirements of fastener 16 and fastener 18 for given prescribed lateral loading conditions, et cetera. Vertical strip element 82 must be capable of resisting the greater of either prescribed or actual uplift forces at structure perimeter 21. For this reason, and that of a potential prying action resulting from backfill loads (described more fully below), strip 82 typically cannot be of a solely unidirectionally-reinforced plastic, such as "fiber-glass" battens are typically made of.

FIG. 10D

The best performing thermal isolator is one entirely of insulating material that also creates an insulating space which can be filled with foam. A strip connector of insulating material 88 with a foam space is consists of entirely integral elements of the same extrusion. Strip connector 88 is also best of material such as high quality RPVC or GRP as described just above. Because these materials are expensive compared to steel, and connector strip 88 is relatively substantial in configuration, careful structural analysis of it is justified to minimize sectional area and therefore cost. As well as providing adequate fastener connection strength as described above, it must have adequate flexural strength, perpendicular to its longitudinal axis, to accommodate forces described below. Reinforcement within plastic section thus cannot be solely unidirectional, as a following discussion treats more thoroughly.

Elements of strip connector 88 at the connection to structure above are a vertical fastening flange 92 and a horizontal bearing flange 94.

Due to out of plane, primarily inward, loads to panel from soil backfill, et cetera, strip connector 88 tends to be rotated inwardly about the bottom of perimeter 21. This causes fastening flange 92 to experience a downward force promoting tear out type failure at any fastener 18 location, thus a solely unidirectionally reinforced plastic, such as "fiberglass battens" are typically made of, would be structurally inadequate for fastening flange 92, any possible uplift forces on structure perimeter 21 notwithstanding.

This rotational force on strip connector 88 causes downward force to bearing flange 94, the fulcrum of the rotational action. This bearing pressure is in addition to, and conceivably exceeds, gravity loads. Thus bearing flange 94 must be designed as a short cantilever for this combined loading criteria.

Insulating strip connector 88 connects to panel 12 with fasteners 16 at a vertical fastening flange 93, and also bears on panel 12 at a horizontal bearing/closure flange 96. Both fastening flange 93 and closure flange 96 must consider much of the same structural requirements discussed above for fastening flange 92 and bearing flange 94 respectively, except that inwardly-applied out-of-plane loads from backfill do not increase these forces. These loads would cause prying action at the connections made with fastener 16 without the presence of a closure lip 98. Entire cantilever distance of closure flange 96 should not be considered in determining bending force at its root because panel 12 can easily take all load at its outer face, and so flange stress-relief strain is acceptable.

The main body of connector strip 88 is a vertical structural web 90. Web 90 must be capable of withstanding flexural forces described above, combined with vertical-axial and flexural forces from eccentrically imposed gravity loads from structure perimeter 21 and flange 23. Thus web 90 can be thought of as a column stabilized from collapse by virtue of its "fixed-end" moment connections. The upper fixed moment connection is good only for inwardly-imposed out-of-plane loads to panel 12, unless bearing flange 94 is fastened to structure flange 23.

An optional integral-screed/waterstop flange 95 would be of a projecting dimension as required in description of screed/waterstop horizontal flange 80 (FIG. 8). Integral waterstop flange 95 would be tend to be more substantial than an element such as flange 80 because it is part of a structural extrusion, and so alignment of flange 95 outer edge at panel 11 joints is less of a concern. Spline/Barrier 72 (FIG. 10D) is not required for alignment, but something like it (but external), or caulk, may still be required to seal waterstop 95 at the joints for wet sites.

Screed/waterstop flange 95 can have a return flange such as flange 62 as does screed/waterstop 19 (FIG. 8), for the same purposes. Or, screed/waterstop 19 can be substituted for flange 95. Flange 95 can of course be included on connector 80 (FIG. 10C).

4. OPERATION

This foundation method varies according to conditions of support during and after modular-structure or floor-member installation. Also, the foundation panel necessary strength and thickness will change according to types and amounts of superimposed loads, and will change to a lesser degree according to panel height for given loads.

To determine the necessary length for each panel in order to create a structural-perimeter kit, one must have site grade information (as trenched), and know the height at which the structure will be set. A simple floor plan with dimensions down to grade at certain intervals, building corners and at breaks in grade, will suffice. Panel lengths should be such that they clear the bottom of the trench by at least about 100 mm (4") to allow footing in-situ concrete placement from only the outside. A minimum clearance of 150 mm (6") makes concrete placement from the outside only easier.

Mobile home (HUD code home) permanent installations can of course be made without a foundation perimeter of genuine structure, where State-approved moment-resisting-pier and/or cable-anchoring systems are utilized at the chassis beams. These systems do not meet the model building codes (such as for site-built structures) however, as does the present invention.

A perimeter-structure of the present invention which is only partially about the perimeter, would be acceptable structurally in most situations in lieu of internal lateral/uplift support systems, according to typical criteria of State-approvals. Panels set only or mostly at locations where backfill is desired anyway, and/or where required structurally, is a viable cost-optimized foundation design. A continuous structural-paneled perimeter is generally preferred, however, for reasons of: allowing backfill grading, keeping out surface water and rain, heat loss control, fire safety, visual screen, allowing low-profile sets, and satisfying model building codes, et cetera.

Mobile homes generally support most or all of their weight via interior supports, which can be simple-supports, such as concrete-block or steel-tripod pier supports, at the chassis beams. Thus the structural-perimeter panels of the present invention can usually be relatively thinner and weaker than that required for normal site-built bearing walls. In general the mobile home panels are preferably installed after all permanent interior simple-supports have been completed, in other words, the mobile home is set first. Keeping in mind that sequence can vary, this method would typically be as follows:

1. Prepare site as required for interior and perimeter footings. Interior supports and footing design can be of any conventional of proprietary means, and simple support is sufficient. Trenching for the paneled perimeter can be imprecise, so that layout effort is easy. Perimeter trenches can conceivably be omitted altogether if the soil conditions and prevalent codes allow, and the concrete is made sufficiently stiff, but a perimeter trench for the footing makes the best foundation.
2. Place interior pads, if in-situ concrete is to be utilized for them.
3. Set mobile home section(s) in place by conventional trailering methods, and onto usual interior simple-supports by conventional methods. If the interior pads are soil-contact treated-wood, then they are set concurrently with the piers.
4. Make utility connections, if preferable to do so now.
5. Hang the foundation panels, all around the perimeter, or as required by structural design. For the case where each panel assembly 11 or 11' (of FIG. 1, 4, or 7) has the top strip 13, 30, or 15 pre-attached, the panel assemblies will attach directly about the perimeter nailer 28 (FIG. 4), or its equivalent. Typically screws or small lag screws would be set through prepunched holes in the top strip into the vertical face of nailer 28.

Panel installation begins at a strategic location, keeping in mind that panels are installed in adjacent-contiguous sequence, as each with a male seam-flange interlocks to the previous-adjacent female seam (per conventional decking seam geometry). As explained in the description section above, the male-female seam shear-attachment is most easily accomplished with an adhesive. When installed continuously about the unit, the last panel must usually be cut to fit up to the edge of the first panel, and can then be attached to it by any manner. When the panel attachment is not continuous, terminal edges of panel can be reinforced with a channel-column element. For access-door openings, a single panel (with a top of cap 54, FIG. 2B) can be set below the pre-situated structure enough to create the opening.

Building corners can be followed by simply vertically saw-kerfing enough of a panel to bend at the corner location, and cutting out enough of the top strip to allow the bend. Thus the panels simply wrap around the corner and keep going. Alternatively, the panels can be cut altogether and started again at the corner, but a corner reinforcing element should be added for this practice.

It is possible that panels could be width-dimensioned to suit particular buildings, so corner elements would accept each adjacent panel coming into a corner, and so field-cutting of the panels could be avoided altogether.

6. Place rebar. A course of rebar is attached to panels, and can be utilized for straightening the panels to a true plane (much as the building itself does along the top) if necessary. The bar can be wire-tied to the flute feet 48, or it can be set upon the tab anchors 46 and tied where necessary. For the purposes of truing panels, the rebar is best of about 16 mm (⅝") diameter.

Another course of rebar can also be set on spacer-blocks in the trenches, but this is not necessary to this design.

7. Place perimeter footing concrete, very preferably with a pump. The concrete is most easily placed from the outside when a plastisizing agent is added, adjusting the mix to create a standard trunnicated-cone concrete slump-test at about 7" (180 mm). Panels are checked for plumb, and adjusted, if necessary, while the concrete is still fluid.

8. Install any vents, if required over what may be built into panels. These vent openings can be cut into the panels, or the vent openings can be installed at the perimeter (floor framing) above the panels.

9. Apply a protective finish to the exterior of panels, if desired. At locations of penetrations or cuts exposing ungalvanized edges of the panels, a zinc-rich paint can first be applied, and any recesses resulting from the cuts be caulked flush. The adjacent panel seams exposed to the exterior can be caulked, before or after any tar treatment. Then one can apply a texture finish or insulation and/or a cement-stucco, if desired.

10. Adjust site grades and backfill against panels as appropriate.

Non-HUD code Modular homes differ from HUD mobile homes in that they do not have a trailer-chassis built it. So generally a significant portion of the structure weight must be supported along the perimeter, and this weight must of course be considered in panel top configuration and in panel thickness. Interior supports (if any), perimeter panels, and concrete are optimally placed concurrently while modular units are on temporary supports. This could also be a two phased, interior to exterior, operation. The single-concrete-placement method would typically be as follows:

1. Prepare site per 1 above. Interior footings may not be present or necessary.
2. Set modular unit(s) in place. Support to level and true, and preferably at locations that do not interfere with permanent support locations.
3. While units are on temporary supports, install any interior supports to unit if the hang-before-concrete-placement variety.
4. Make utility connections, if preferable to do so now.
5. Hang panels per above, considering how the panel design for this structure would affect the installation.
6. Place rebar per above.
7. Place footing concrete for interior and perimeter per above. Panels are checked for plumb, and adjusted, if necessary, while the concrete is still fluid.
8. Install any interior supports that are the install-after-concrete-placement variety.
9. Remove temporary supports.
10. Install any vents per above.
11. Finish panels per above.
12. Backfill grades per above.

Note that because panel attachment goes very quickly, it is preferably closed-in simultaneously with, or after, any interior concrete placement, for either mobile or modular structures. This allows better access to the interior work, and tighter scheduling possibilities. Removal of temporary support is aided by creating larger-than-normal crawl space access opening(s) or by not enclosing the entire perimeter with panels, if desired. Normal minimum building code required crawl space access openings will generally allow removal of temporary supporting elements, however.

For site-built structures the panels attach to a pre-situated (by any method) linear member such as a conventional wood rim-joist, or they can attach to a pre-situated planar-floor-assembly of any type. Where these attachments allow easy access to each side of the panels for concrete placement, any need to use concrete plastisizer is avoided, and it is more practical to place the concrete without a pump, if desired. The steps to take for installing panels of this embodiment are easily determined from the description above.

SCOPE OF THE INVENTION

This invention is independent of the method of geometry definition for the structure or element which is holding the panels in place. It is simply one which effectively exploits that geometry presence for the construction of a foundation. Thus, the geometry defining structure can be any object capable of being physically pre-supported in its finished position, and benefits by having a permanent foundation.

While most of the disclosure continuously mentions "perimeter" in association with these foundation wall panels, they can be used identically, or in different embodiments, as interior foundation walls.

These design of these apparati and methods is made to be as generally applicable as possible. This described method is possible with an assortment of existing products put to new types of use. For example, a panel of most any corrugation pattern will be able to: make the same type of top connections; utilize the same benefits of the diverging cuts along the bottom edge; and provide ventilation via the flutes, if desired.

In so far as breadth of applications, here is yet another example: These panels provide the most efficient means of placing a retrofit perimeter foundation beneath an older home (which was originally built upon now-inadequate piers). With the use of these panels, the home does not have to be lifted up and set back down. Concrete forms do not have to be set and stripped (or block-work is omitted), so avoiding all that difficult work that must be done with great difficulty in a cramped crawl-space. Ponywalls do not have to be built (and made to fit into tight, irregular spaces), and then shear-sheathed.

With this new method of retrofit, the perimeter posts and piers are shifted clear of the panel location (as must be done anyway), then the panels are then simply attached and cast in concrete, etc.

Of course the variations in panel connection and in pre-situated member type can vary considerably from the operation described herein, given the permutations resulting from various panel embodiments and applications, all utilizing the same basic principles and methods presented. Although the description above contains many specificities, these should not be construed as limiting the scope of the invention, but merely as providing illustration of the preferred embodiments. The specifics shown merely depict illustration of a few of the possible configurations that utilize these cost-effective foundation panels beneficially. Variations and adaptations of this new foundation construction method will suggest themselves to a practitioner of the construction method and material arts. For example, the deformation pattern examples shown here can easily be varied considerably, or omitted altogether where load conditions allow.

It must be stressed that the present invention is independent of the physical guide, which is required to be presituated for the attachment and collocation of these structural panels. A few examples of that guide are given, but it can be just about anything structurally capable.

In accordance with these and other possible variations and adaptations of the present invention, the scope of the invention should be determined in accordance with the following claims, only, and not taught solely in accordance with that embodiment within which the invention has been taught.

I claim:

1. A method of constructing a foundation wall for a building, comprising the steps:

providing an elongate physical guide means along a line at a predetermined height above ground at which the top of said foundation wall is desired to exist, said foundation wall to extend downward between said elongate physical guide means and the earth, preparing the surface of the earth beneath said elongate physical guide means for foundation support to achieve predetermined foundation design loads, including lateral loads, shear loads, uplift loads and bearing loads, forming a plurality of corrugated structural panels, wherein each panel includes a lower portion having footing engagement means formed integrally in said panel, and wherein each panel is formed to be a predetermined height required at its location between said elongate physical guide means and said prepared earth, and said footing engagement means is cut or formed to achieve said foundation design loads, attaching to said elongate physical guide means in a manner so as to hang between it and said prepared surface of the earth, said plurality of structural panels, each of which said structural panels is of a suitable thickness and strength to support a corresponding part of a building above, each of which said structural panels so extends toward earth, in a substantial plane where said foundation wall is desired, and thereafter placing a flowable hardenable building material about the lower portion of each of the attached plurality of said structural panels to form a footing therefor, and making each said panel become supported in the flowable hardenable building material to achieve said design loads, and serve as said foundation wall for said building.

2. The method according to claim 1 wherein said elongate physical guide means is a portion of a prefabricated modular building set upon supports.

3. The method according to claim 1 wherein said elongate physical guide means is a presituated elongate floor framing member temporarily held in place by a series of strut elements.

4. The method according to claim 1 wherein said elongate physical guide means is a portion of a presituated planar floor grid assemblage.

5. The method according to claim 1 wherein each of said corrugated structural panels is made of galvanized steel and has vertically extending flutes.

6. The method according to claim 5 wherein said footing engagement means is a plurality of cut or formed tabs formed in said flutes and bent to an angle of between 5° and 90°.

7. An apparatus for constructing a foundation wall for a building, where an elongate physical guide has been presupported along a line at a predetermined height above ground at which the top of said foundation wall is to be formed, said foundation wall to extend downward between said elongate physical guide means and the earth, the earth having been prepared for foundation support to achieve predetermined foundation design loads, including lateral loads, shear loads, uplift loads and bearing loads, the foundation wall construction apparatus comprising in combination:

an elongate physical guide means presupported along a line at a predetermined height above ground at which the top of said foundation wall is to be formed, at least one corrugated panel having sufficient thickness and strength to form a portion of said foundation of said building corresponding to the width of said panel, said panel having an upper portion and a lower portion, means for connecting and suspending said upper portion of said panel to said physical guide means whereby said panel hangs vertically, and wherein said lower portion of said panel hangs toward said prepared earth, and said lower portion having footing engagement means for engaging concrete or other flowable hardenable material placed around said lower portion while said panel is suspended from its upper portion, wherein said footing engagement means is cut or formed as a portion of said panel, and wherein said panel becomes a foundation support achieving said predetermined design loads for said building when said concrete or flowable hardenable material has hardened.

8. The apparatus of claim 7 further comprising an elongate bearing spacer adapted to be located between said elongate physical guide means and the top edge of said corrugated panel, said spacer so providing a ventilation space.

9. The apparatus of claim 8 further comprising a continuous screen element carried by said elongate bearing spacer.

10. The apparatus of claim 7 wherein said elongate physical guide means is a portion of a prefabricated modular building set upon supports.

11. The apparatus of claim 7 wherein said elongate physical guide means is a presituated elongate floor framing member temporarily held in place by a series of strut elements.

12. The apparatus of claim 7 wherein said elongate physical guide means is a portion of a presituated planar floor grid assemblage.

13. An apparatus for construction of a building foundation wall where an elongate physical guide has been presupported along a line at a predetermined height above ground at which the top of said foundation wall is to be formed, said foundation wall to extend downward between said elongate physical guide and the earth, the earth having been prepared for foundation support, the foundation wall construction apparatus comprising in combination:

an elongate physical guide means presupported along a line at a predetermined height above ground at which the top of said foundation wall is to be formed, a plurality of corrugated, fluted panels, each of said panels having sufficient thickness and strength to support a corresponding part of said building when oriented in a vertical plane with its corrugation flutes aligned vertically, the top edge of each said panel having means for connection to and suspension from said guide in a manner where each said panel will hang toward earth, adjacent to each other, wherein each of said panels, for a particular location along which said foundation wall is desired, is able to be selected from a group of heights so as to best correspond to the desired height of said panel at said particular location, whereby the lower extremity of each of said panels has footing engagement means for engaging concrete or other flowable hardenable material placed around said lower extremity while said panel is suspended, and wherein said engagement means is cut or formed integrally in each of said panels, and upon the hardening of said material, each of said panels becomes situated in said material, so becoming a foundation for said building.

14. The apparatus of claim 13 wherein said elongate physical guide means is a prefabricated modular building set upon supports.

15. The apparatus of claim 13 wherein said elongate physical guide means is a presituated elongate floor framing member temporarily held in place by a series of strut elements.

16. The apparatus of claim 13 wherein said elongate physical guide means is a line of a presituated planar floor grid assemblage.

17. The apparatus of claim 13 wherein each of said panels is of galvanized corrugated steel decking material.

18. The apparatus of claim 13 further comprising elongate bearing spacers adapted to be located between said elongate physical guide and the top edge of each of said corrugated panels, said spacer so providing a space wherein air ventilation can occur.

19. The apparatus of claim 18 further comprising continuous screen elements carried by said elongate bearing spacers.

20. The apparatus of claim 13 wherein said footing engagement means is a series of bent tabs either cut or formed in the lower extremity of each panel.

21. In combination, a prefabricated modular building and apparatus for constructing a perimeter foundation for said building, wherein said building is set upon supports so that the lower periphery of said building forms a line above ground at which the top of said perimeter foundation is to be formed, the earth under said lower periphery having been prepared for foundation support, comprising:

a prefabricated modular building set upon supports, a plurality of galvanized steel corrugated, fluted panels, each of said panels having sufficient thickness and strength to support a corresponding part of said building where oriented in a vertical plane with its corrugation flutes aligned vertically, the top edge of each said panel having means for connection to and suspension from said lower periphery of said building in a manner where each said panel will hang toward earth, adjacent to each other, and wherein each of said panels, for a particular location along which said perimeter foundation is desired, is able to be selected from a group of heights so as to best correspond to the desired height of said panel at said particular location, and wherein the lower extremity of each of said panels has footing engagement means for engaging concrete or other flowable hardenable material placed around said lower extremity while said panel is suspended, wherein said engagement means is cut or formed integrally in each of said panels, and upon the hardening of said material, each of said panels becomes situated in said material, so becoming said perimeter foundation for said building.

* * * * *